US007645814B2

(12) United States Patent
Schrey et al.

(10) Patent No.: US 7,645,814 B2
(45) Date of Patent: Jan. 12, 2010

(54) CORE MATERIAL

(75) Inventors: Alexander Schrey, Brüggen (DE); Gotthard Wolf, Mettmann (DE); Rolf Rietzscher, Mettmann (DE)

(73) Assignee: Georg Fischer AG, Schaffhausen (CH)

( * ) Notice: Subject to any disclaimer, the term of this patent is extended or adjusted under 35 U.S.C. 154(b) by 673 days.

(21) Appl. No.: 10/513,630

(22) PCT Filed: Apr. 19, 2003

(86) PCT No.: PCT/EP03/04107

§ 371 (c)(1),
(2), (4) Date: Nov. 5, 2004

(87) PCT Pub. No.: WO04/000484

PCT Pub. Date: Dec. 31, 2003

(65) Prior Publication Data

US 2005/0176845 A1 Aug. 11, 2005

(30) Foreign Application Priority Data

Jun. 19, 2002 (DE) ..... 102 27 512

(51) Int. Cl.
*B22C 1/02* (2006.01)

(52) U.S. Cl. ..... 523/139; 523/142; 523/143

(58) Field of Classification Search ..... 523/139, 523/142, 143

See application file for complete search history.

(56) References Cited

U.S. PATENT DOCUMENTS

| | | | | |
|---|---|---|---|---|
| 4,852,629 | A * | 8/1989 | Fechter et al. | 164/16 |
| 5,641,015 | A | 6/1997 | Challand et al. | |
| 5,911,269 | A | 6/1999 | Brander et al. | |

FOREIGN PATENT DOCUMENTS

| | | |
|---|---|---|
| DE | 195 25 307 | 1/1997 |
| DE | 40 02 440 | 8/1997 |
| DE | 199 39 062 | 2/2001 |
| EP | 0 644 006 | 3/1995 |
| EP | 195 49 469 | 6/1997 |
| EP | 0 891 954 | 1/1999 |

* cited by examiner

*Primary Examiner*—Vickey Nerangis
(74) *Attorney, Agent, or Firm*—Bachman & LaPointe, P.C.

(57) ABSTRACT

A method for the production of cores and molds for casting molds, based on a base molding material and an organic or inorganic binding agent and an additive. According to the method, pre-forming substances are used in order to dispense with the use of sizing substances and to prevent the formation of ribs.

9 Claims, 1 Drawing Sheet

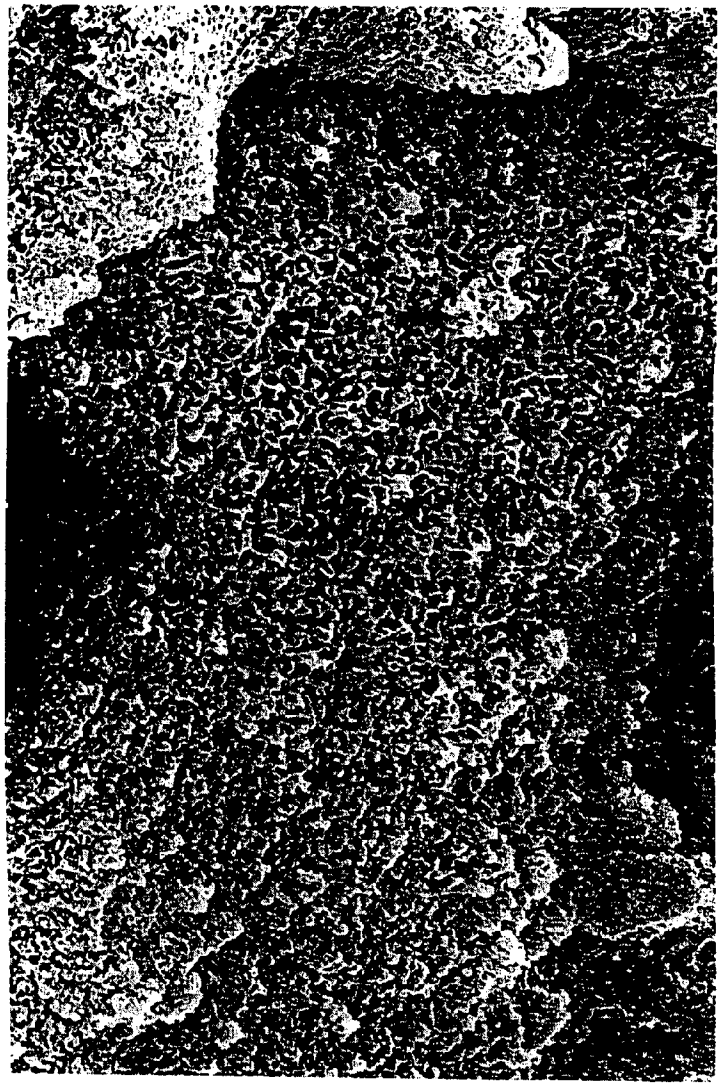
Fig.

CORE MATERIAL

BACKGROUND OF THE INVENTION

The invention relates to a process for producing casting cores or molds for casting molds comprising a mold base material and a binder and to casting cores or molds after production of the process.

The function of casting cores is to form cavities in the casting or undercut outer contours. This kind of casting cores are produced conventionally in core boxes by means of core shooting units, where the molding sand, provided with binder and, where appropriate, with additives, is introduced using compressed air into the cavities of the core mold boxes. The binders used are generally liquid synthetic resins or inorganic binders.

The invention relates to all organic and inorganic mold and core production processes, preferably to the urethane cold box process and/or the resole-$CO_2$ process. Likewise possible are physical processes, examples being ultrasound processes.

Urethane cold box coremaking takes place in cold core boxes using organic binder systems, which are gas-cured directly in the core box by means for example of tertiary amines. Solidification of the molding material mixture (e.g., quartz sand, organic binding system, curing agent) takes place after the molding material has been introduced into the cold core box, by means of a gaseous catalyst or of a gaseous tertiary amine. The individual components are mixed beforehand in specialty apparatus. One advantage of this urethane cold box process, among others, lies in the achievement of high strengths in the cores or molds.

Other processes, e.g., what are called resole-$CO_2$ processes, are coremaking processes with alkali-condensed phenolic resin binder which for curing is gassed with carbon dioxide. As with the urethane cold box process, the molding material is based generally on quartz sand mold base material. This process is distinguished by the prevention of "veins" in the casting operation. Under examination by scanning electron microscopy, cores produced by the known resole-carbon dioxide process exhibit a typical pore structure. It has been found that this pore structure prevents the abovementioned expansion defects ("veins"). Disadvantages of this gassing process are lower strengths, the reasons for which are increased erosion and inadequate thermal stability.

The finished molded cores can be coated with a wash. Washes are refractory materials in powder, liquid or paste form for producing a thin coating on the casting cores. The core wash has a number of functions. They include heat insulation, smoothing, the prevention of sticking of metal to the mold wall, the prevention of veining, and hence the assurance of reliable separation of the casting from the mold wall when the mold is discharged.

After the casting operation of the finished casting the casting cores are removed from the casting. The casting cores are removed for example by blasting, vibration, blowing out, knocking or washing out.

DE 195 25 307 A1 disclosed a casting core for casting molds. The proposal is for a casting core for casting molds comprising a dry substance which is solidified by means of a binder and which loses its shape as a result of exposure to water.

DE 195 49 469 A1 describes a casting core for cast molding, comprising molding sand solidified by means of a water-soluble binder based on polyphosphates, the binder being instantized sodium polyphosphate and a mixing ratio of 3 to 7 parts by weight of binder and 0.5 to 2 parts by weight of water per 100 parts by weight of molding sand being provided.

DE 199 14 586 A1 discloses a resin-based binder for producing foundry sands for use in foundry practice. The binder mixture for core sand production is composed of a single component (single resin) or of a mixture of one or more single components (resin mixture) with additives.

The invention is based on the object of providing a casting core or a mold of the type specified above which have a pore structure, while avoiding the aforementioned disadvantages. In particular it shall no longer be necessary to use a core wash. It is also intended that the disadvantageous veining in the casting operation be avoided.

SUMMARY OF THE INVENTION

In accordance with the invention the foregoing object is achieved by adding a pore former to the molding material and/or to the binder.

BRIEF DESCRIPTION OF THE DRAWINGS

The single FIGURE shows the porous structure of a casting core material made in accordance with the present invention wherein the average core size is from 100 nm to 500 nm.

DETAILED DESCRIPTION

In the course of their decomposition by acid formers or by exposure to heat, pore formers give off, for example, carbon dioxide which produces the desired fine-pored structure in the molding material mixture. The use of physical methods as well, e.g., ultrasound methods, may contribute to the formation of fine-pored structures.

The pore former is not limited to the production of carbon dioxide. Any pore-forming additive is possible that produces the desired pores in the casting core or the casting mold; for example, substances which generate nitrogen would also be possible.

The presence of the pore structure makes it unnecessary for the casting core to be subsequently treated with a wash, in order to prevent expansion defects.

As pore formers it is preferred to use substances which generate carbon dioxide, such as ammonium carbonate, ammonium hydrogencarbonate, sodium carbonate and/or sodium hydrogencarbonate, for example. Sodium hydrogencarbonate has been found to be particularly suitable.

Advantageously an acidifier is added and/or heat is supplied to the substance which forms carbon dioxide. The carbon dioxide is released in particular as a result of an acidic environment or by supply of energy in the form of heat. In order to control the quantity of carbon dioxide released and/or else to specify the time of carbon dioxide release, an acidifier—tartar, for example—is added to the substance which forms carbon dioxide.

In accordance with one particularly preferred embodiment of the process the binder is composed in a 1:1 ratio of a phenolic resin component and an isocyanate component, the two components being introduced into the mold material simultaneously or in succession and subsequently mixed.

Advantageously it is also possible to add the pore former to the core molding material mixture simultaneously or subsequently with the binder.

It is likewise possible to add the substance which forms carbon dioxide together with a component of the binder.

Owing to the casting core production process detailed above, the casting cores have a material structure which is porous. At the least there are formed in the casting core porous regions which exhibit the desired advantages in the casting operation and during removal of the casting cores in the metal casting.

The key technical advantages are of a simplified, less complex casting process as compared with the prior art. This is because the fine pore structure and the appropriate strength of the casting cores render core wash treatment unnecessary.

Specified below is one particularly advantageous working example of the composition of the mixture of quartz sand and binder for the production process of the invention.

100 parts by weight quartz sand 0.6 parts by weight resin (phenolic resin, for example)

0.6 parts by weight isocyanate 0.75 weight fractions pore former, e.g., sodium hydrogencarbonate The weight fractions of resin and isocyanate can be between 0.5 and 1, depending on the desired strength of the casting cores. In general, resin and isocyanate are added in equal amounts, i.e., in a 1:1 ratio.

The pore former is generally added in an amount of from 0.5 to 1 weight fractions.

As an option it is possible to add from 0.2 to 0.7 weight fraction of an acid former, tartar for example, to the mixture in order to control the release of carbon dioxide.

Described below is an exemplary, typical process scheme of a casting core production process. The steps of the process, in the urethane cold box process, are specifically as follows:

weighing out the quartz sand or volumetric metering running the quartz sand into a batch mixer metering the resin component and isocyanate component via metering pumps. Metering may take place in parallel or sequentially the pore former is added sequentially, in parallel with both binder components or in parallel with one binder component, the acid former being added where appropriate the mixing time is from 10 to 120 seconds, depending on the desired requirements and type of mixer processing the wet mixture on the cast shooting machine removal of the cores heat treatment at, for example, 200° C., it being possible for the heat treatment to be different, depending on the application placing of the finished cores into the sand mold for the actual casting operation

The invention claimed is:

1. A process for producing a casting mold comprising:

providing a composition comprising a base mold material, a binder, an acidifier and a gas generating pore former, including controlling a release of gas by adding the acidifier to the gas generating pore former in a controlled wt. fraction wherein release of gas from the gas generating pore former is controlled as a function of wt. fraction of the added acidifier and the gas generating pore former, wherein the acidifier is present in a wt. fraction of between 0.2 to 0.7 parts by weight with respect to 100 parts by weight of the base mold material and the gas generating pore former is present in a wt. fraction of between 0.5 to 1.0 with respect to 100 parts by weight of the base mold material; and forming a casting mold from the composition.

2. A process according to claim 1, including heat treating the casting mold.

3. A process according to claim 1, wherein the pore former comprises a carbonate salt.

4. A process according to claim 1, wherein the pore former is selected from the group consisting of ammonium carbonate, ammonium hydrogen carbonate, sodium carbonate, sodium hydrogen carbonate and mixtures thereof.

5. A process according to claim 1, wherein the pore former generates at least one of carbon dioxide and nitrogen.

6. A process according to claim 1, including adding the pore former to the base mold material simultaneously with the binder.

7. A process according to claim 1, including adding the pore former to the base mold material subsequent to the binder.

8. A process according to claim 1, wherein the binder comprises between 0.5:1 to 1:1 ratio of a phenolic resin component and an isocyanate component, wherein the two components are introduced into the base mold material simultaneously and then mixed.

9. A process according to claim 8, wherein the base mold material comprises quartz sand.

* * * * *

UNITED STATES PATENT AND TRADEMARK OFFICE

CERTIFICATE OF CORRECTION

PATENT NO. : 7,645,814 B2
APPLICATION NO. : 10/513630
DATED : January 12, 2010
INVENTOR(S) : Schrey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 969 days.

Signed and Sealed this

Twenty-eighth Day of December, 2010

David J. Kappos

David J. Kappos
*Director of the United States Patent and Trademark Office*